US006964260B2

(12) United States Patent
Samoto et al.

(10) Patent No.: US 6,964,260 B2
(45) Date of Patent: Nov. 15, 2005

(54) ELECTRONIC ENGINE CONTROL DEVICE

(75) Inventors: Haruhiko Samoto, Shizuoka (JP); Tomoaki Kishi, Shizuoka (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 96 days.

(21) Appl. No.: 10/233,898

(22) Filed: Aug. 29, 2002

(65) Prior Publication Data

US 2003/0062025 A1 Apr. 3, 2003

(30) Foreign Application Priority Data

Aug. 29, 2001 (JP) ..... 2001-260440

(51) Int. Cl.[7] ..... F02P 5/00

(52) U.S. Cl. ..... 123/406.13; 123/406.11; 123/319

(58) Field of Search ..... 123/406.13, 406.11, 123/319, 376, 333, 335, 394, 198

(56) References Cited

U.S. PATENT DOCUMENTS

| | | | | |
|---|---|---|---|---|
| 4,138,601 A | | 2/1979 | Nakamura et al. | |
| 4,587,937 A | | 5/1986 | Masuda | |
| 4,645,027 A | | 2/1987 | Masuda | |
| 4,941,442 A | * | 7/1990 | Nanyoshi et al. | 123/333 |
| 4,989,570 A | * | 2/1991 | Kuribara et al. | 123/494 |
| 5,003,948 A | * | 4/1991 | Churchill et al. | 123/352 |
| 5,950,597 A | * | 9/1999 | Kamio et al. | 123/397 |
| 6,014,958 A | * | 1/2000 | Miwa et al. | 123/520 |
| 6,047,679 A | * | 4/2000 | Matsumoto et al. | 123/396 |
| 6,397,585 B2 | * | 6/2002 | Kitajima et al. | 60/284 |
| 6,711,492 B1 | * | 3/2004 | Pursifull et al. | 701/114 |

FOREIGN PATENT DOCUMENTS

| | | |
|---|---|---|
| JP | 60-050037 | 8/1985 |
| JP | 04-164155 | 6/1992 |
| JP | 05-302531 | 11/1993 |
| JP | 07-180644 | 7/1995 |
| JP | 07-243373 | 9/1995 |
| JP | 07-332122 | 12/1995 |
| JP | 08-189367 | 7/1996 |
| JP | 09-303167 | 11/1997 |
| JP | 10-227252 | 8/1998 |
| JP | 11-036898 | 2/1999 |
| JP | 2002-067741 | 3/2002 |

* cited by examiner

*Primary Examiner*—John T. Kwon
(74) *Attorney, Agent, or Firm*—Knobbe, Martens, Olson & Bear, LLP

(57) ABSTRACT

An electronic engine control unit for a motorcycle or other two-wheeled vehicle gradually decreases engine torque at the time of a failure so as to eliminate an uneasy feeling that an operator might experience if the engine torque were to be reduced abruptly. When a failure is detected, a throttle valve is closed gradually by initially closing the valve quickly and then slowly closing the valve so as to obtain a smooth decrease in engine torque. In addition, the ignition timing is changed gradually toward retardation to gradually decrease engine torque. Alternatively, the ignition pulses to the cylinders are thinned out gradually to cause a gradual decrease in engine torque. As a further alternative in the case of a multi-cylinder engine, the ignition pulses are stopped on a cylinder-by-cylinder basis to cause a gradual decrease in engine torque.

23 Claims, 16 Drawing Sheets

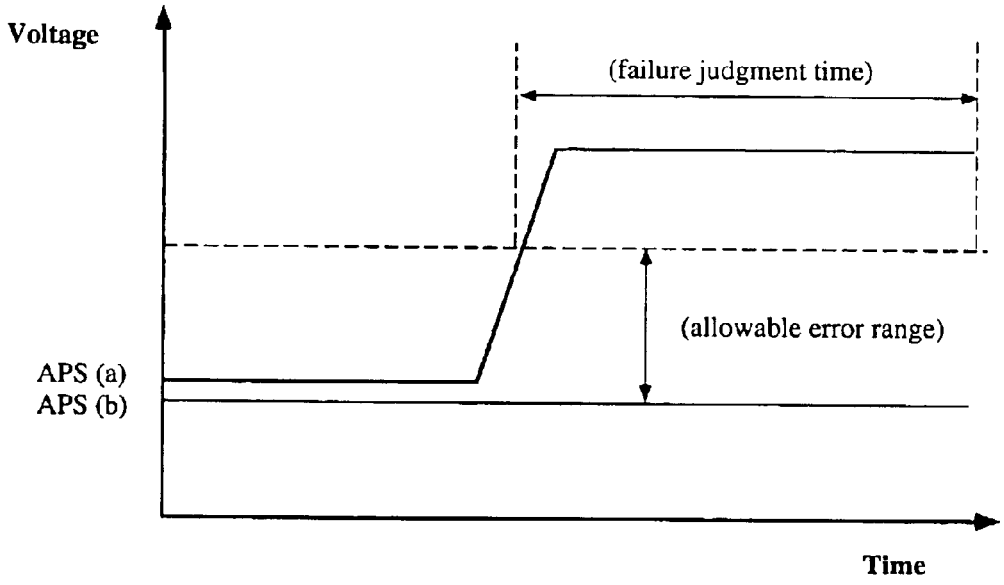
*Figure 4(a)*
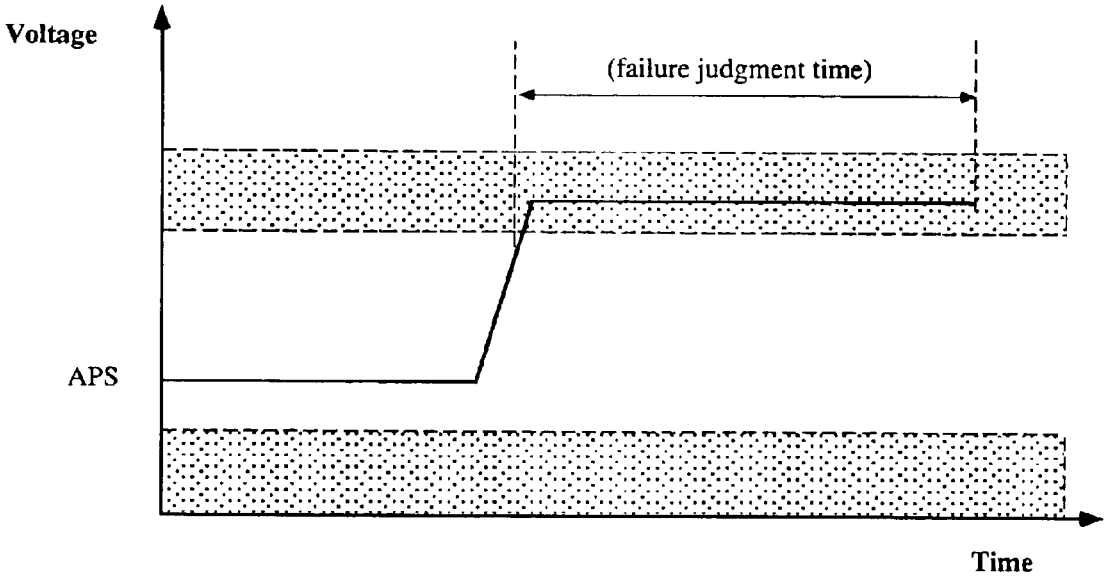
*Figure 4(b)*
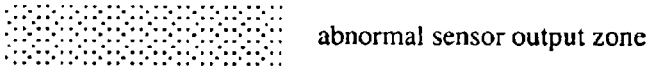

ELECTRONIC ENGINE CONTROL DEVICE

PRIORITY INFORMATION

This application is based on and claims priority under 35 U.S.C. §119 to Japanese Patent Application No. 2001-260440, filed on Aug. 29, 2001, the entire contents of which are hereby expressly incorporated by reference herein.

BACKGROUND OF THE INVENTION

1. Field of the Invention

This invention relates to an electronic control device for controlling an engine, and is suited particularly for controlling a fuel-injected engine to provide a safe engine shutdown procedure in response to a failure or an error in an engine management system or a vehicle sensor.

2. Description of the Related Art

Two-wheeled vehicles (e.g., motorcycles) typically incorporate internal combustion engines to provide power to propel the two-wheeled vehicles in a variety of popular applications. In addition, the engines in two-wheeled vehicles incorporate sophisticated engine management systems to ensure maximum performance, increased fuel economy, and cleaner exhaust emissions. Various sensors within the engine management systems are used to measure conditions to provide requested engine torques efficiently.

Due to varying vehicle environments, engine management sensors can experience errors and malfunctions. Many engine management systems have duplicate sensors to ensure reliability. In addition, some engine management systems can abruptly reduce engine torque if sensors fail, to thereby provide operators with "caution" modes of operation on effectively less powerful vehicles.

SUMMARY OF THE INVENTION

Known electronic engine control devices respond to a system failure by performing a fail-safe operation in which engine torque is quickly decreased, such as an action of stopping fuel supply to the engine. However, as far as two-wheeled vehicles are concerned, a rapid decrease in engine torque would cause the operator to have an uneasy feeling because of the abrupt change in engine torque and a resulting abrupt change in vehicle speed. In view of the foregoing, an object of this invention is to provide an engine control device that performs a fail-safe operation in response to a system failure or error to gradually reduce the engine torque without causing the operator to experience uneasy feeling.

One aspect of the preferred embodiments is an engine control device that includes a sensor failure detection system. The sensor failure detection system monitors a plurality of sensors that are responsive to operational parameters of the two-wheeled vehicle. The failure detection system also detects an unacceptable output of at least one of the sensors, and the controller then selectively varies engine parameters to slow the engine at a predetermined gradual rate when an improper operation is detected. Thus, any feeling of uneasiness that an operator may experience when the engine speed is slowed abruptly is reduced or eliminated by the engine control device.

The sensors detected by the engine control device include a side stand switch, an inverted detection switch, a throttle actuator sensor, and a throttle position sensor.

In one particular preferred embodiment, the engine control device uses engine parameters to slow the engine at a predetermined gradual rate including closing a throttle valve or gradually retarding the ignition timing. The engine control device can also slow the engine at a predetermined gradual rate by stopping ignition to at least one of the variable combustion chambers through a relay circuit.

BRIEF DESCRIPTION OF THE DRAWINGS

The present invention will be described below in connection with the accompanying drawing figures in which:

FIGS. 4(*a*) and 4(*b*) are diagrams illustrating failure judgment performed in the accelerator opening sensor failure judgment section of FIG. 2;

DETAILED DESCRIPTION OF THE PREFERRED EMBODIMENT

A preferred embodiment of the present invention will be described below in connection with the accompanying drawing figures.

Figure 1:
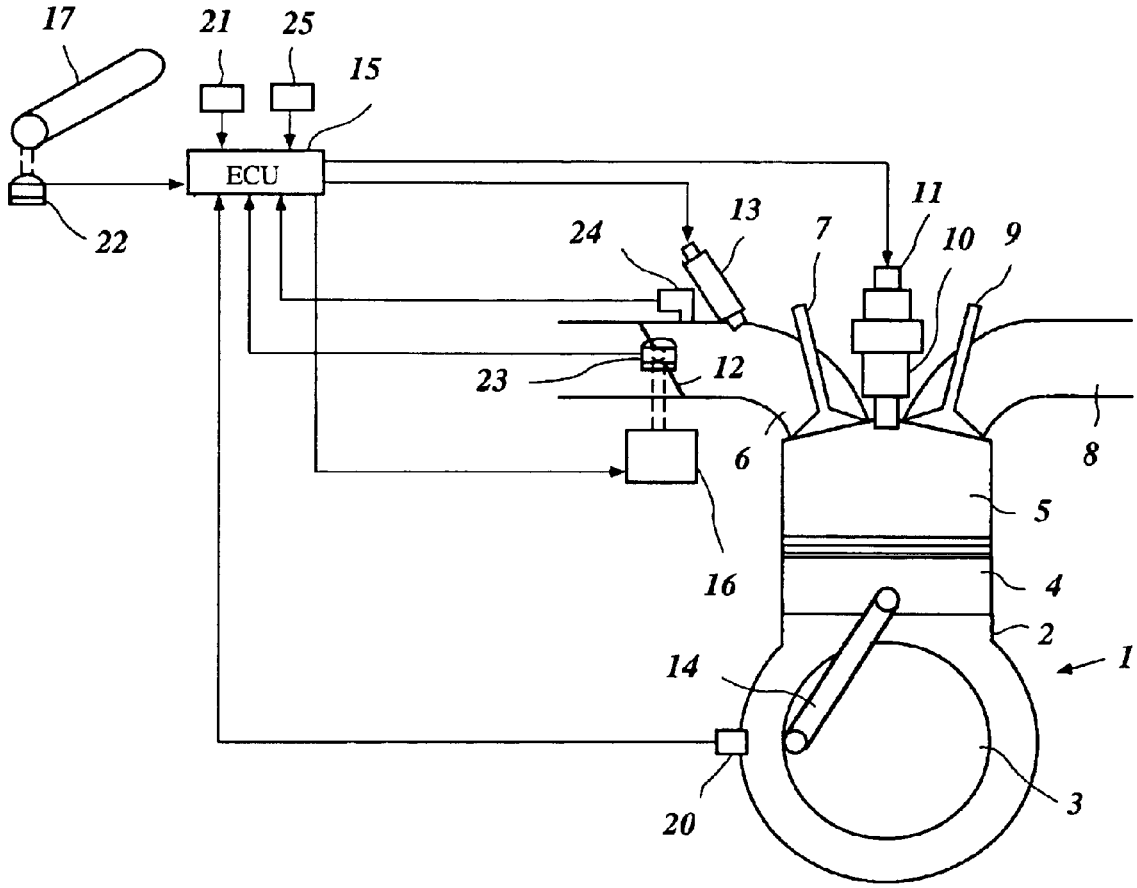
FIG. 1 is a schematic structural diagram of an engine for a motorcycle and its control device.

FIG. 1 is a schematic structural diagram showing an example of an engine for a motorcycle and its control device. In the illustrated embodiment, the engine 1 is a four-cylinder four-stroke engine. Each cylinder of the engine comprises a cylinder body 2, a crank shaft 3, a piston 4, a connecting rod 14, a combustion chamber 5, an intake pipe 6, an intake valve 7, an exhaust pipe 8, an exhaust valve 9, an ignition plug 10, and an ignition coil 11.

The intake pipe 6 includes a throttle valve 12 that is adapted to be opened and closed in response to the opening of an accelerator 17, which for a motorcycle or the like, is positioned on the handlebars. The intake pipe 6 also includes an injector 13 positioned on the downstream side from the throttle valve 12. The injector 13 operates as a fuel injection device. The injector 13 is connected to a filter (not shown), a fuel pump (not shown) and a pressure control valve (i.e., a regulator) (not shown) disposed in a fuel tank (not shown). The illustrated engine 1 has an independent intake system such that a respective injector 13 is provided on the intake pipe 6 for each cylinder of the engine. In the illustrated embodiment, the throttle valve 12 for each cylinder is arranged such that opening and closing control is performed by a stepper motor 16 instead of being mechanically coupled to the accelerator 17.

The operating conditions of the engine 1 are controlled by an engine control unit (ECU) 15, which is responsive to input signals representing operating parameters of the engine 1 detected by a plurality of sensors. For example, a crank angle sensor 20 detects the rotation angle (or phase) of the crank shaft 3. A throttle opening sensor 23 detects the opening (i.e., the position) of the throttle valve 12. A plurality (e.g., 4) of intake pipe pressure sensors 24 detect the respective intake pipe pressure in the intake pipe 6 of each cylinder. In addition, a side stand switch 21 detects the housing condition of a side stand (i.e., whether the side stand (or kick stand) is raised or lowered). An accelerator opening sensor 22 detects the amount of operation of the accelerator 17 (i.e., detects the position of the accelerator as it is turned by the motorcycle operator). A turnover switch 25 detects whether the vehicle is upright or turned over. Other sensors may also be used to detect other operating conditions of the motorcycle.

The engine control unit 15 receives the detection signals of the sensors as input signals, and, as described in more detail below, generates control signals as output signals to the fuel pumps (not shown), to the injectors 13, to the ignition coils 11, and to the stepper motor 16. The engine control unit 15 comprises a microcomputer (not shown) or the like. Various other kinds of calculation circuits may be substituted for the microcomputer.

Figure 2:
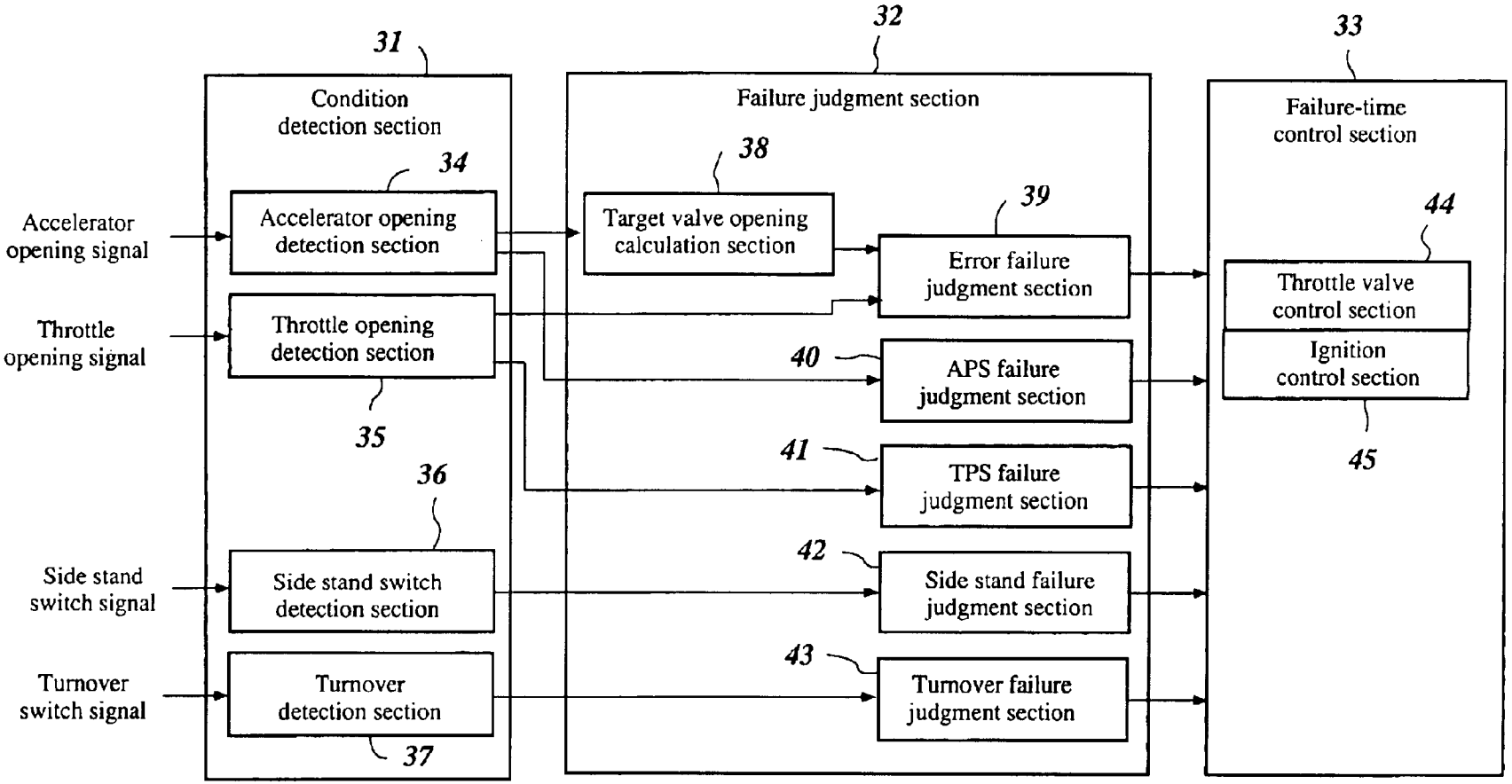
FIG. 2 is a block diagram showing an embodiment of an engine control device of this invention.

FIG. 2 is a block diagram of the processing performed in the engine control unit 15 to provide fail-safe operation of the engine 1 of the motorcycle in the event that a failure or error condition is detected. The main processing functions performed by the engine control unit 15 are illustrated by a condition detection section 31, a failure judgment section 32, and a failure-time control section 33.

The condition judgment section 31 comprises an accelerator opening detection section 34, a throttle opening detection section 35, a side stand switch (SW) detection section 36, and a turnover detection section 37. The accelerator opening detection section 34 detects an accelerator opening (i.e., accelerator position) based on an accelerator opening signal from the accelerator opening sensor 22. The throttle opening detection section 35 detects an throttle opening based on a throttle opening signal from the throttle opening sensor 23. The side stand switch detection section 36 detects a housing condition of the side stand based on a side stand switch signal from the side stand switch 21. The turnover detection section 37 detects a turnover based on a turnover switch signal from the turnover switch 25.

The failure judgment section 32 comprises a target valve opening calculation section 38, an error failure judgment section 39, an accelerator opening (i.e., position) sensor (APS) failure judgment section 40, a throttle opening (i.e., position) sensor (TPS) failure judgment section 41, a side stand failure judgment section 42, and a turnover failure judgment section 43. The target valve opening calculation section 38 calculates a target opening of the throttle valve from the accelerator opening detected in the accelerator opening detection section 34. The error failure judgment section 39 judges a failure associated with the opening error of the throttle valve from the target valve opening calculated in the target valve opening calculation section 38 and the throttle opening detected in the throttle opening detection section 35. The accelerator opening sensor failure judgment section 40 judges a failure of the accelerator opening sensor 22 from the accelerator opening detected in the accelerator opening detection section 34. The throttle opening sensor failure judgment section 41 judges a failure of the throttle opening sensor 23 from the throttle opening detected in the throttle opening detection section 35. The side stand failure judgment section 42 judges a failure associated with the side stand from the housing condition of the side stand detected in the side stand switch detection section 36. The turnover failure judgment section 43 judges a failure associated with the turnover from the turning-over condition detected in the turnover detection section 37.

The failure time control section 33 comprises a throttle valve control section 44 and an ignition control section 45. The throttle valve control section 44 controls the opening of the throttle valve 12. The ignition control section 45 controls the igniting condition of the ignition plugs 10.

The target valve opening calculation section 38 responds to the magnitude of the accelerator opening detected in the accelerator opening detection section 34 and calculates a normal throttle opening for the throttle valve 12. Generally, the normal throttle opening is calculated as the detected accelerator opening multiplied by a given factor.

Figure 3:
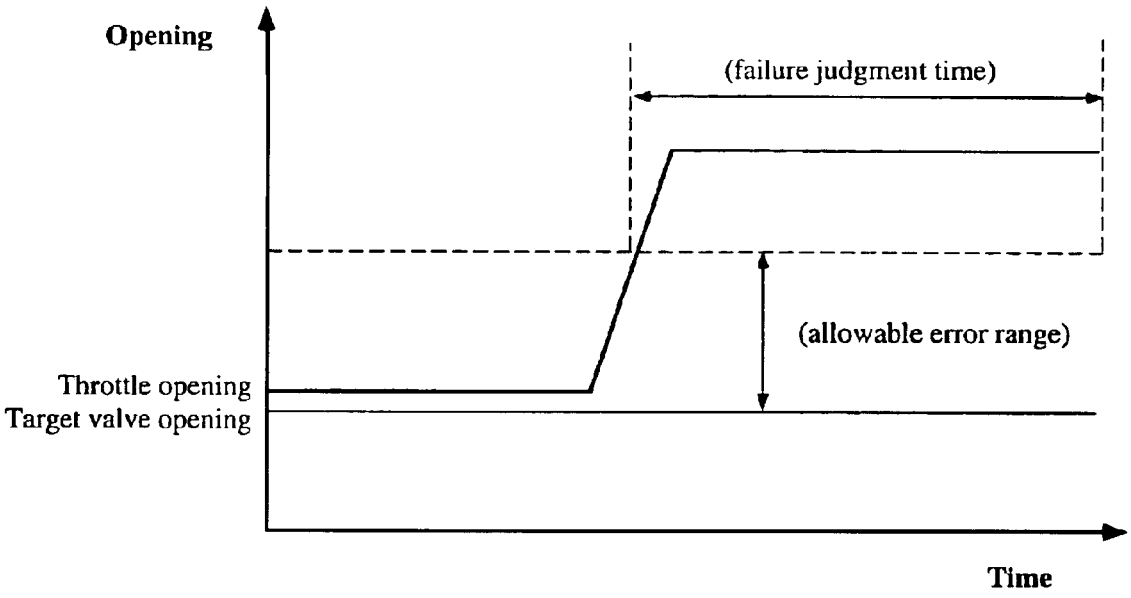
FIG. 3 is a diagram illustrating failure judgment performed in the error failure judgment section of FIG. 2.

The error failure judgment section 39 receives the target valve opening calculated by the target valve opening calculation section 38 and receives the detected throttle opening from the throttle opening detection section 35. The error failure judgment section 39 judges that a failure has occurred when a difference between a target valve opening and the detected throttle opening is excessive. For example, as illustrated in FIG. 3, when the difference between the throttle opening and the target value opening remains outside a given acceptable error range for more than a given failure judgment time, the error judgment section 39 generates an error indication.

The accelerator opening sensor (APS) failure judgment section 40 receives input information from the accelerator opening sensor 22 and the accelerator opening detection section 34. As shown in FIG. 4(*a*), the accelerator opening detected in the accelerator opening detection section 34 by the accelerator opening sensor 22 comprises a main accelerator opening APS(a) value and a sub accelerator opening APS(b) value. In a first error detection operation illustrated in FIG. 4(*a*), the APS failure judgment section 40 judges that either one or both of the accelerator opening sensor 22 and the accelerator opening detection section 34 has failed and generates an error indication when either the APS(a) value or the APS(b) value remains outside a given allowable error range for more that a given failure judgment time with respect to the other value. In a second error detection operation illustrated in FIG. 4(*b*), the APS failure judgment section 40 generates an error indication when the accelerator opening APS detected in the accelerator opening detection section 34 remains within an abnormal sensor output range (either of the shaded voltage ranges in FIG. 4(*b*)) for more then a given failure judgment time.

Figure 5:
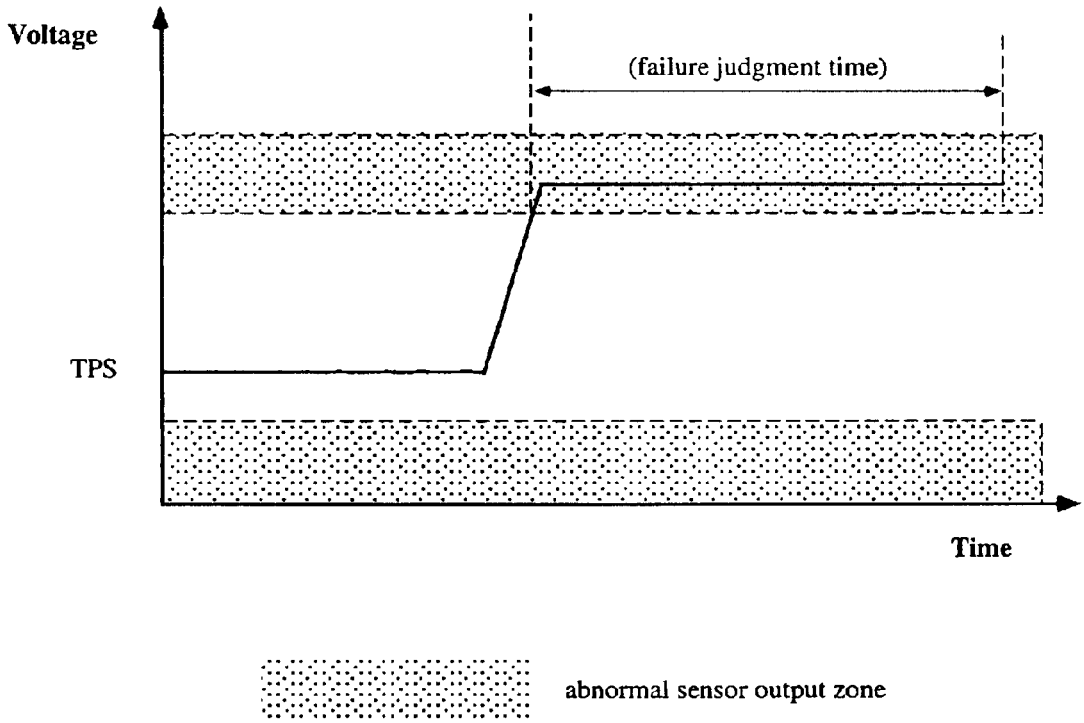
FIG. 5 is a diagram illustrating failure judgment performed in the throttle opening sensor failure judgment section of FIG. 2.

The throttle opening sensor failure judgment section 41 receives the throttle opening (TPS) detected in the throttle opening detection section 35. As illustrated in FIG. 5, the throttle opening sensor failure judgment section 41 judges that either one or both of the throttle opening sensor 23 and the throttle opening detection section 35 have failed when the throttle opening (TPS) remains within an abnormal sensor output range (either of the shaded voltage ranges in FIG. 5) for more than a given failure judgment time.

The side stand failure judgment section 42 receives the side stand condition value from the side stand switch detection section 36 and also receives a value responsive to the current engine speed. The side stand failure judgment section 42 judges that a failure of the side stand housing has occurred when the side stand is not housed and the engine speed exceeds a given value for more than a given failure judgment time.

Figure 6:
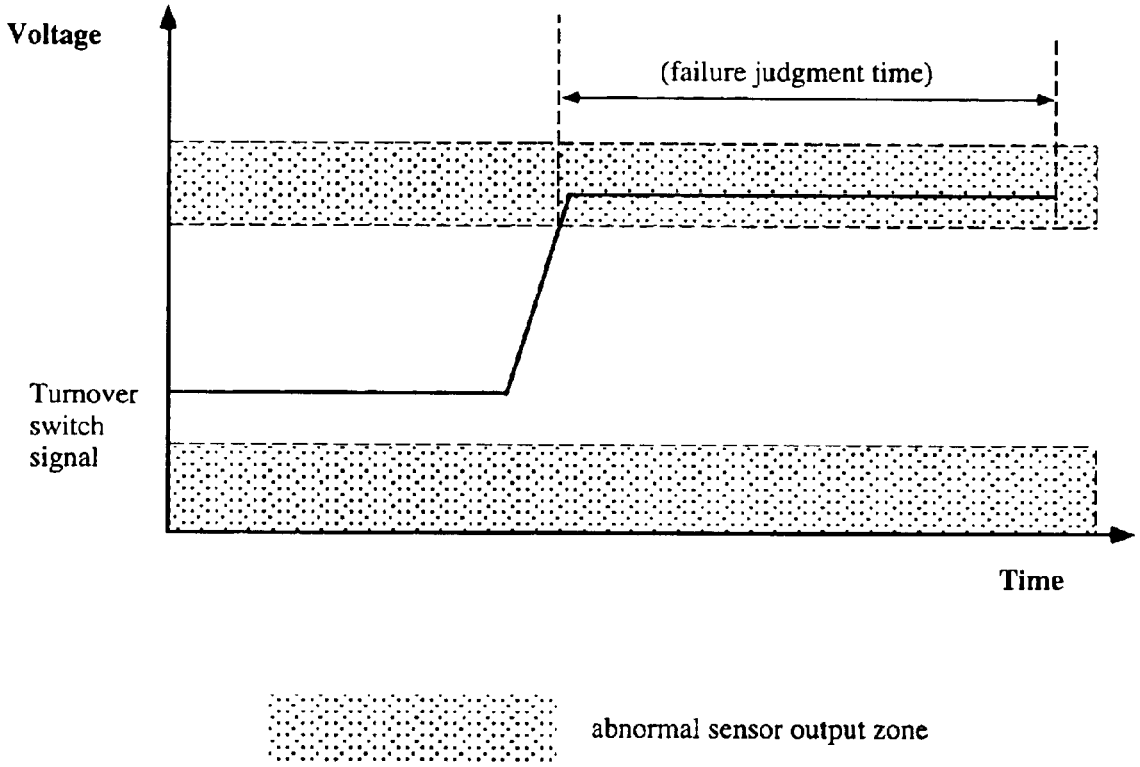
FIG. 6 is a diagram illustrating failure judgment performed in the turnover failure judgment section of FIG. 2.

As illustrated in FIG. 6, the turnover failure judgment section 43 judges that a turnover failure has occurred when the turnover switch signal detected in the turnover detection section 37 remains within an abnormal output range (i.e., one of the shaded voltage ranges in FIG. 6) for more than a given failure judgment time.

Figure 7:
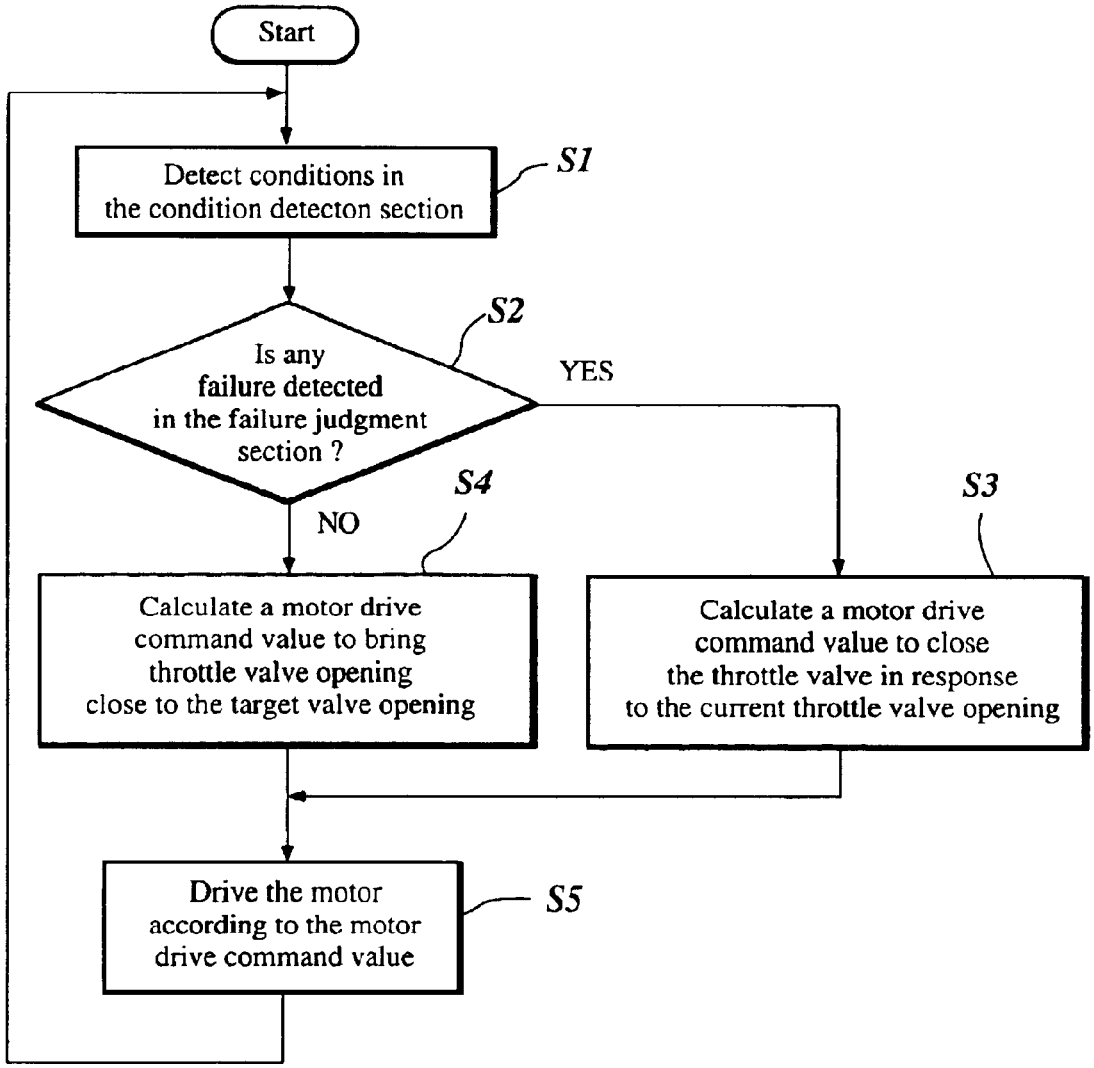
FIG. 7 is a flowchart of the processing performed in the throttle valve control section of FIG. 2.

FIG. 7 illustrates a flowchart of the processing performed in the throttle valve control section. In a first step S1, various conditions described above are detected in the condition detection section 31. Then, in a step S2, the failure judgment section 32, judges whether any failure has been detected. If any failure is detected, the procedure advances to a step S3. If no failure is detected, the procedure advances to a step S4.

In the step S3, the procedure calculates a motor drive command value to close the throttle valve in response to the current throttle valve opening. The procedure then advances to a step S5.

In the step S4, the procedure calculates a motor drive command value to bring the throttle valve opening close to the target valve opening calculated in the target valve opening calculation section 38. The procedure then advances to the step S5.

In the step S5, procedure drives the stepper motor 16 according to the motor drive command value calculated in the step S3 or the value calculated in the step S4. Thereafter, the procedure returns to the step S1 to again detect the various conditions.

Figure 8A:
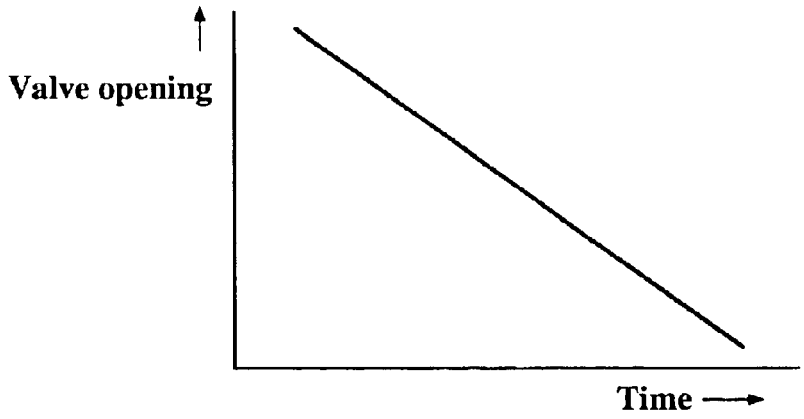
FIGS. 8(*a*), 8(*b*) and 8(*c*) are diagrams illustrating throttle valve closing control performed in the processing of FIG. 7.
Figure 8B:
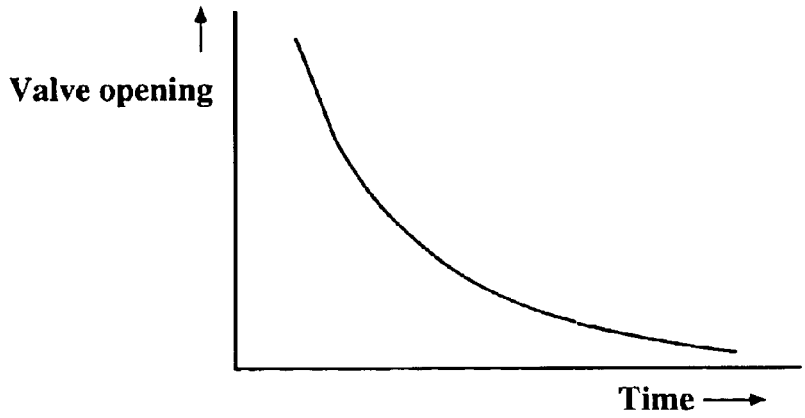
Figure 8C:
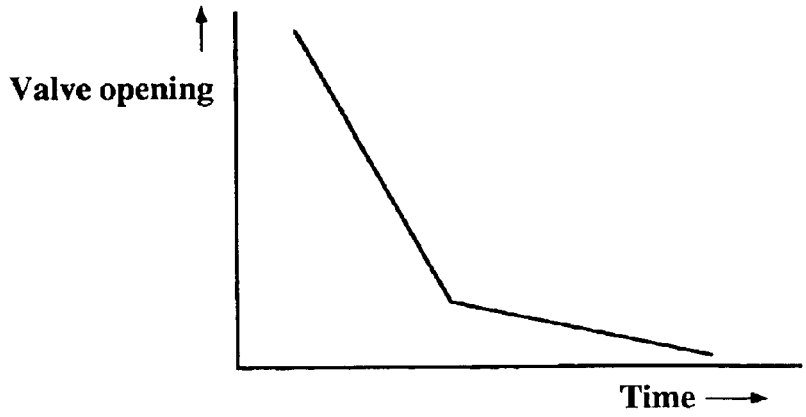

The generation of the motor drive command in the step S3 to close the throttle valve when a failure is detected is illustrated in FIGS. 8(*a*), 8(*b*) and 8(*c*). In particular, FIG. 8(*a*) illustrates a closing control function in which the valve opening is closed uniformly with time (i.e., at a constant speed) as represented by a linear downwardly sloping line. FIG. 8(*b*) illustrates a closing control function in which the valve closing speed is decreased with time, as represented by a downwardly convex curve. FIG. 8(*c*) illustrates a closing control function in which the valve is closed at a greater speed for a first time duration when the valve is initially closed, and then during a second time duration, the valve is closed at a slower speed. The closing speed in FIG. 8(*c*) comprises two linear functions, wherein the closing speed changes in accordance with the first linear function (i.e., a relatively steep downwardly sloping line) for the first duration and changes in accordance with a second linear function (i.e., a less steep downwardly sloping line) for the second duration.

Figure 9:
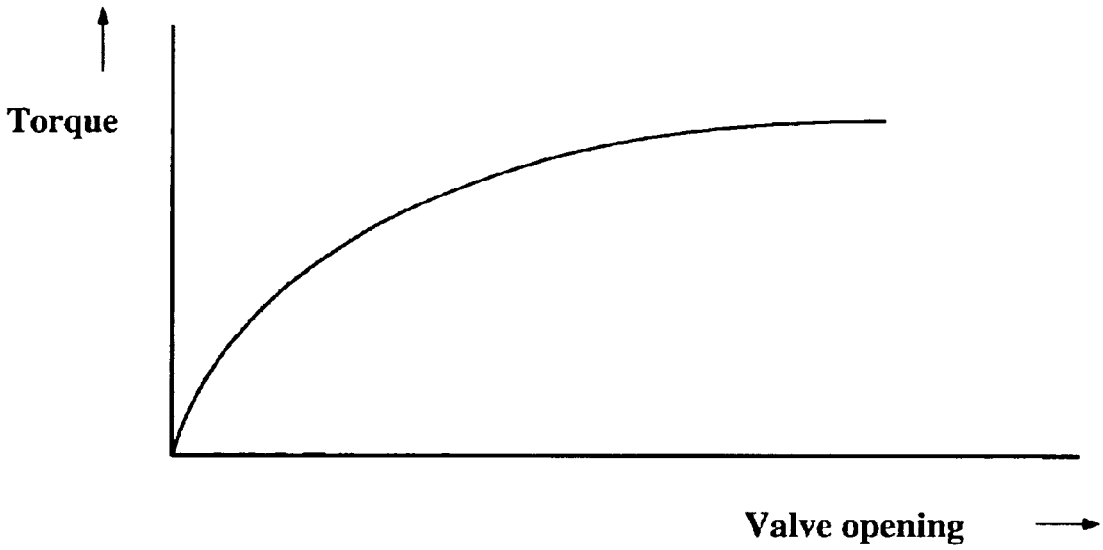
FIG. 9 is a diagram illustrating a relation between throttle valve opening and engine torque.

As illustrated in FIGS. 8(*a*), 8(*b*) and 8(*c*), various kinds of closing speed control of the throttle valve are possible, but either the closing speed control of FIG. 8(*b*) or the closing speed control of FIG. 8(*c*) is preferred over the closing speed control of FIG. 8(*a*) in order to offset the torque characteristics of many engines. For example, FIG. 9 represents the relationship of engine torque and throttle valve opening as a generally upwardly convex curve in which engine torque increases at steep slope when the throttle valve opening is small and the slope decreases with increasing throttle valve opening. Therefore, for a vehicle with an intermediate or a large displacement engine that has an engine torque that varies over a large dynamic range, the throttle closing speed is preferably set in the shape of a downwardly convex curve, such as the curve in FIG. 8(*b*) or in the shape of a downwardly broken line, such as in FIG. 8(*c*), to provide a smooth reduction in engine torque at the time when a fail-safe occurs so as to eliminate the feeling of uneasiness of the operator that might be caused by an abrupt change in speed. On the other hand, the uniform linear slope of FIG. 8(*a*) is acceptable for a vehicle having an engine with a relatively small displacement and an engine torque that varies over a smaller dynamic range, because the feeling of uneasiness is not so strong even if the throttle valve is closed at a uniform slope.

Figure 10:
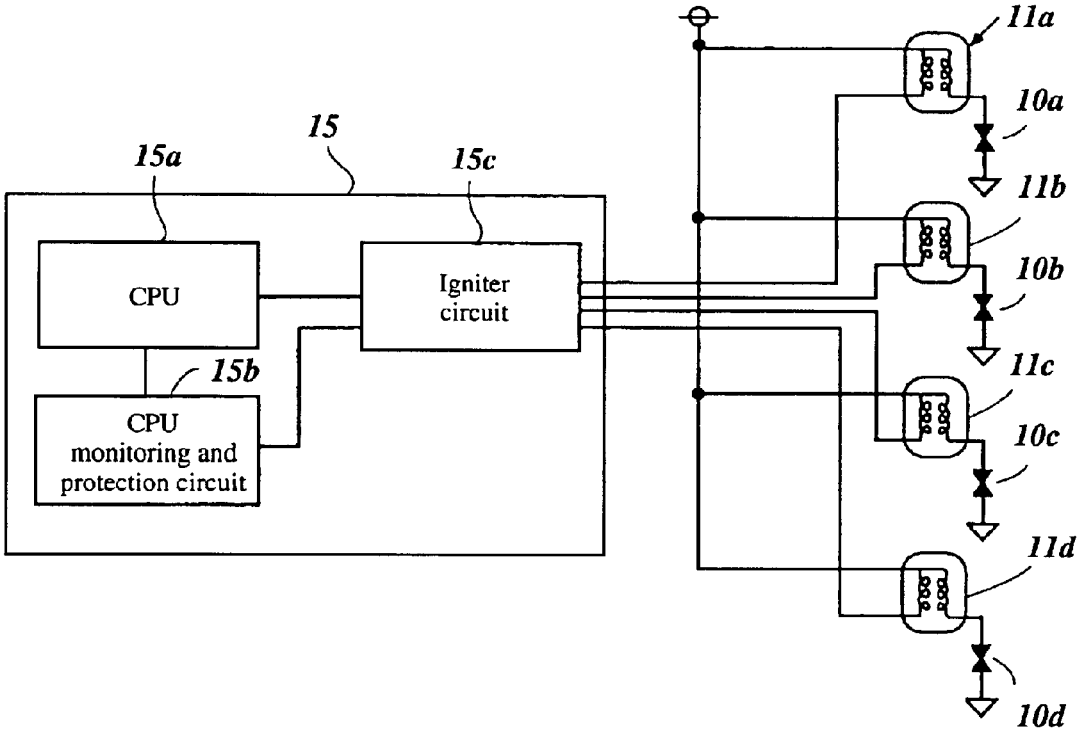
FIG. 10 is a block diagram showing an example of the ignition control section of FIG. 2.

FIG. 10 illustrates a schematic structural diagram of the ignition control section 45 of the engine control unit 15. For the purpose of illustrating the ignition control functions, the engine control unit 15 comprises a CPU 15*a*, a CPU monitoring and protection circuit 15*b*, and an igniter circuit 15*c*. The CPU 15*a* generates ignition pulse signals to drive the ignition coils 11 for each cylinder (shown as ignition coils 11*a*, 11*b*, 11*c* and 11*d* in FIG. 10). The CPU monitoring and protection circuit 15*b* monitors and protects the CPU 15*a*. Preferably, the CPU monitoring and protection circuit 15*b* comprises a subsidiary CPU other than the main CPU 15*a* so that failure of the main CPU 15*a* does not cause the CPU monitoring and protection circuit 15*b* to also fail. The igniter circuit 15*c* receives the ignition pulse signals from the CPU 15*a* and converts the ignition pulse signals into drive signals that are provided as input signals to the ignition coils 11. The ignition drive signals from the igniter circuit 15*c* are amplified by the respective ignition coils 11*a*, 11*b*, 11*c*, 11*d*, and the amplified outputs from the ignition coils are discharged into the respective ignition plugs 10*a*, 10*b*, 10*c*, 10*d* to cause combustion within the respective cylinders.

Figure 11:
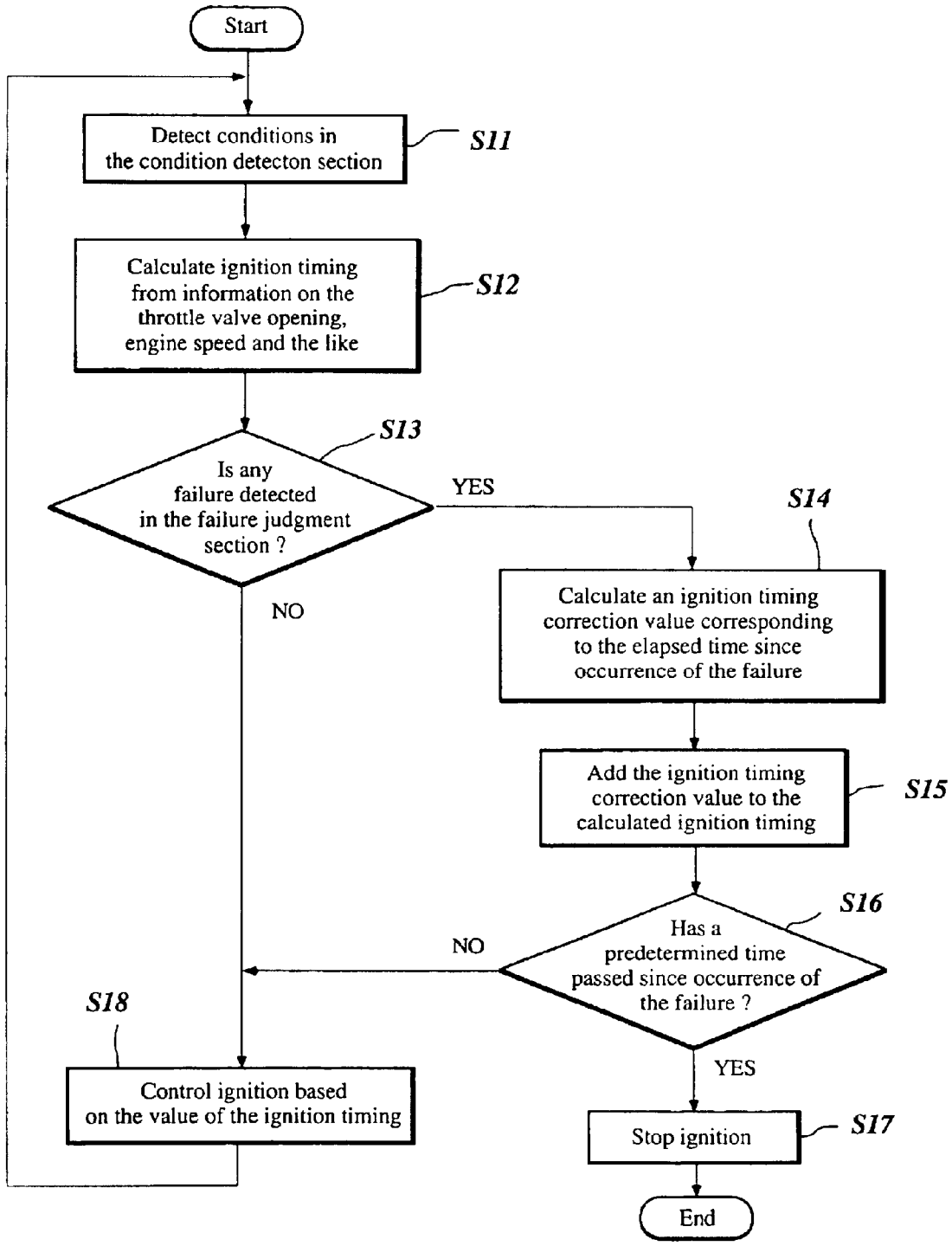
FIG. 11 is a flowchart of the processing performed in the ignition control section of FIG. 10.

FIG. 11 illustrates a flowchart of the processing performed in the ignition control section 45. In a first step S11, various conditions described above are detected in the condition detection section 31

Then, in a step S12, the ignition timing value is calculated from input information representing the throttle valve opening, the engine speed, and the like. Thereafter, in a step S13, the procedure judges whether any failure is detected in the failure judgment section 32. If any failure is detected, the procedure advances to a step S14. If no failure is detected, the procedure advances to a step S18.

In the step S14, the procedure calculates an ignition timing correction value corresponding to an elapsed time since occurrence of the failure. The procedure then advances to a step S15 where the ignition timing correction value calculated in the step S14 is added to the ignition timing value calculated in the step S12 to generate a new ignition timing value. The procedure then advances to a step S16.

In the step S16, the procedure judges whether a given time has passed since occurrence of the failure. If the given time has passed, the procedure advances to a step S17. If the given time has not passed, then the procedure advances to the step S18.

In the step S17, the ignition is stopped and the procedure terminates.

In the step S18, the procedure performs ignition control based on the ignition timing value calculated in the step S12 or the ignition timing value calculated in the S15 in accordance with the path taken at the decision step S13. Thereafter, the procedure returns to the step S11 to repeat the foregoing steps.

Figure 12:
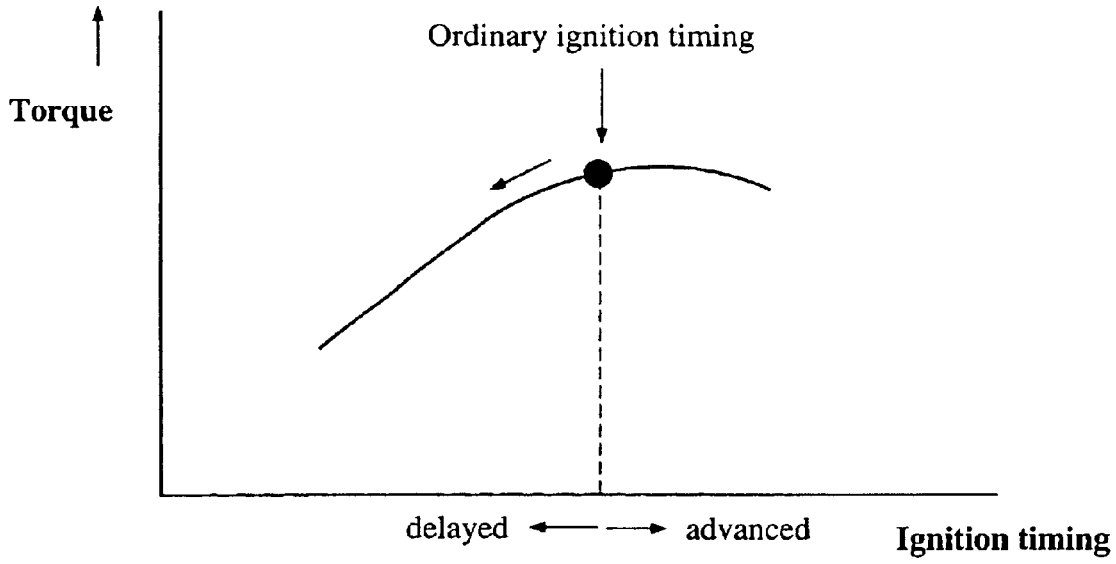
FIG. 12 is a diagram illustrating a relation between ignition timing and engine torque.

The step S14 and the step S15 of FIG. 11 perform delayed ignition timing as illustrated in FIG. 12. As illustrated by the intersection of a torque curve and a vertical dashed line, the ignition timing for each cylinder of an engine is usually set to occur at a time with respect to the position of the cylinder to obtain the maximum torque from the engine. This time is referred to as the ordinary ignition timing in FIG. 12. If the ignition timing is set to a value later than the ordinary ignition timing (i.e., the ignition timing is delayed (e.g., moved to the left in FIG. 12)), the engine torque decreases. In this illustrated embodiment, fail-safe control is performed according to the processing of FIG. 11 such that the ignition timing is delayed gradually with the amount of time that has elapsed since occurrence of the failure to decrease engine torque gradually. Thus, the fail-safe operation of the engine can be performed without causing the driver to have an uneasy feeling such as may occur if the engine speed is changed abruptly.

Figure 13:
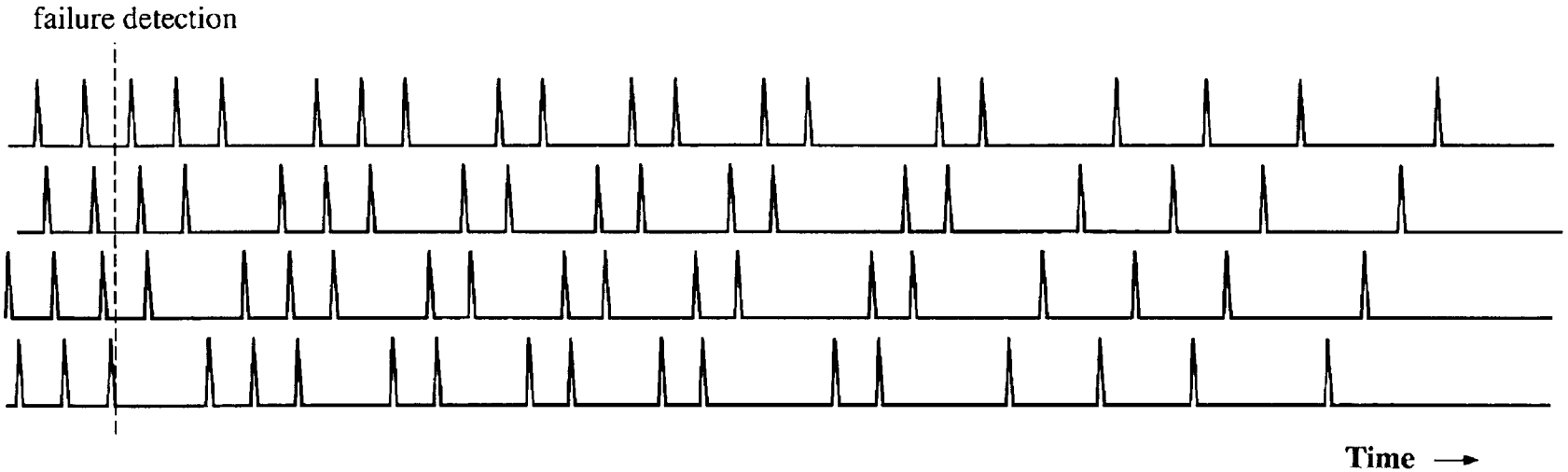
FIG. 13 is a diagram illustrating a gradual decrease in engine torque by thinning-out of the ignition pulses (i.e., by selectively suppressing one or more ignition pulses in the ignition sequences)

FIG. 13 illustrates an alternative procedure for controlling the ignition to gradually decrease the engine torque in response to a detected failure. The procedure of FIG. 13 may be use in place of the delayed ignition timing procedure of FIG. 11 or the procedure of FIG. 13 may be used in addition to the procedure of FIG. 11. As described below, the procedure of FIG. 13 causes the ignition pulses to be thinned out gradually. That is, selected ignition pulses to the ignition coils 11 and thus to the ignition plugs 10 are suppressed to reduce the torque generated by the engine.

In the example illustrated in FIG. 13, the ignition is thinned out by initially suppressing the ignition to one cylinder in each ignition sequence. For example, in FIG. 13, the ignition pulses to the cylinders are illustrated as occurring normally in the order cylinder 1, cylinder 2, cylinder 3, cylinder 4, and then repeating. Assuming an error or failure is detected at a time represented by the vertical dashed line in FIG. 13, the thinning out process operates by first suppressing the ignition pulse applied to the fourth cylinder in the first ignition sequence that occurs after the error or failure detection. Then, in the second ignition sequence, the procedure suppresses the ignition pulse to the third cylinder. In the third ignition sequence, the procedure suppresses the ignition pulse to the second cylinder. In the fourth ignition sequence, the procedure suppresses the ignition pulse to the first cylinder. The suppression of the ignition pulses to the fourth, third, second and first cylinders is repeated in the fifth through twelfth ignition sequences. In the twelfth ignition sequence and again in the fourteenth sequence, the ignition pulse to the fourth cylinder is also suppressed in addition to the suppression of the ignition pulse to the first cylinder. In selected subsequent sequences, the ignition pulses to combinations of two cylinders are suppressed. With increased time after failure, ignition pulses to three cylinders are suppressed during selected sequences. The rate at which the ignition pulses to one or more of the cylinders is suppressed (i.e., the rate at which the ignition pulses are thinned out) is increased with elapsed time to the final stopping of the ignition. In accordance with this method, engine torque is decreased gradually to effect the failsafe operation of the engine without causing the driver to have an uneasy feeling that might be caused by an abrupt reduction of the engine torque.

Figure 14:
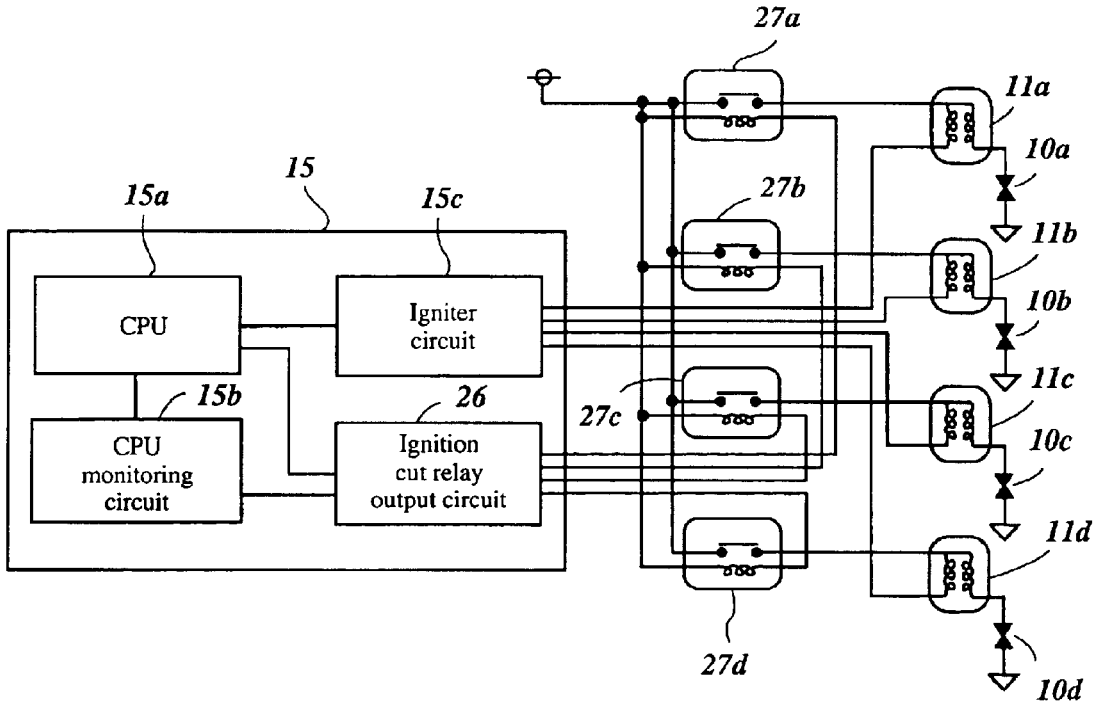
FIG. 14 is a block diagram showing another example of the ignition control section of FIG. 2.
Figure 15:
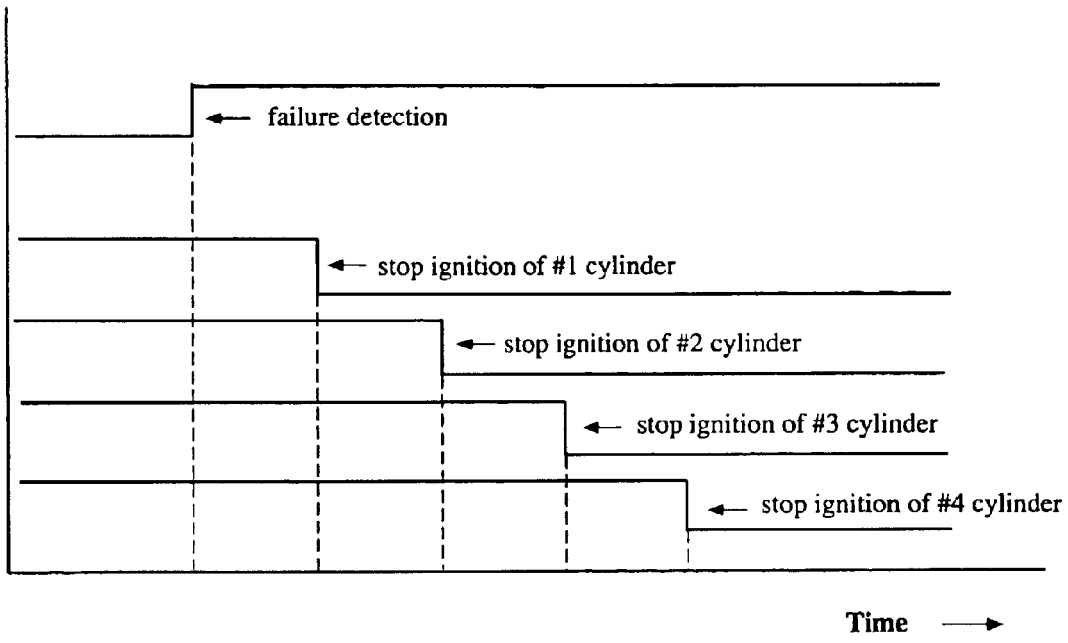
FIG. 15 is a diagram illustrating a gradual decrease in engine torque by cylinder-by-cylinder stopping of ignition.

FIG. 14 and FIG. 15 illustrate a circuit and a procedure, respectively, for gradually decreasing engine torque at the time of failure by using ignition control to stop the ignition on a cylinder-by-cylinder basis. The circuit and procedure of FIGS. 14 and 15 may be used in place of the delayed ignition timing procedure of FIG. 11 or the ignition thinning-out procedure of FIG. 13. The circuit and procedure of FIGS. 14 and 15 may also be used in addition to either or both of the procedures of FIG. 11 and FIG. 13.

FIG. 14 illustrates a circuit in which this cylinder-by-cylinder stopping of ignition can be performed without requiring a command from the CPU, that is the cylinder-by-cylinder stopping can occur in response to an analog error signal in addition to being responsive to commands from the CPU. In FIG. 14, an ignition cut relay output circuit 26 is added in the engine control unit 15 to provide a portion of the functions of the engine control section 45 (FIG. 2). In addition to being responsive to commands from the CPU 15*a*, the ignition cut relay output circuit 26 is also responsive to analog error or failure signals so that the ignition cut relay output circuit 26 will also operate even if the CPU 15*a* fails.

The ignition cut relay output circuit 26 drives a plurality of ignition cut relays 27*a*, 27*b*, 27*c*, 27*d* respectively disposed between the ignition coils 11*a*, 11*b*, 11*c*, 11*d* and a power source. During ordinary engine operation, the ignition cut relay output circuit 26 generates control signals to hold the contacts of the ignition cut relays 27*a*, 27*b*, 27*c*, 27*d* closed so that the ignition pulses from the igniter circuit 15*c* are communicated to the ignition coils 11*a*, 11*b*, 11*c*, 11*d*. When the failure judgment section 32 judges the existence of some failure, the outputs from the ignition cut relay circuit 26 to the ignition cut relays 27*a*, 27*b*, 27*c*, 27*d* are stopped to cause the ignition cut relays 27*a*, 27*b*, 27*c*, 27*d* to be opened successively as shown in FIG. 15. In a particular embodiment, the ignition cut relays 27*a*, 27*b*, 27*c*, 27*d* are opened in order to suppress the ignition pulses to the ignition coils 11*a*, 11*b*, 11*c*, 11*d* in order of the cylinder number from the first cylinder to the fourth cylinder. This cylinder-by-cylinder stopping of ignition also causes the engine torque to be decreased gradually, thereby effecting fail-safe without causing the driver to have an uneasy feeling that might be caused by an abrupt change in the engine torque.

Figure 16:
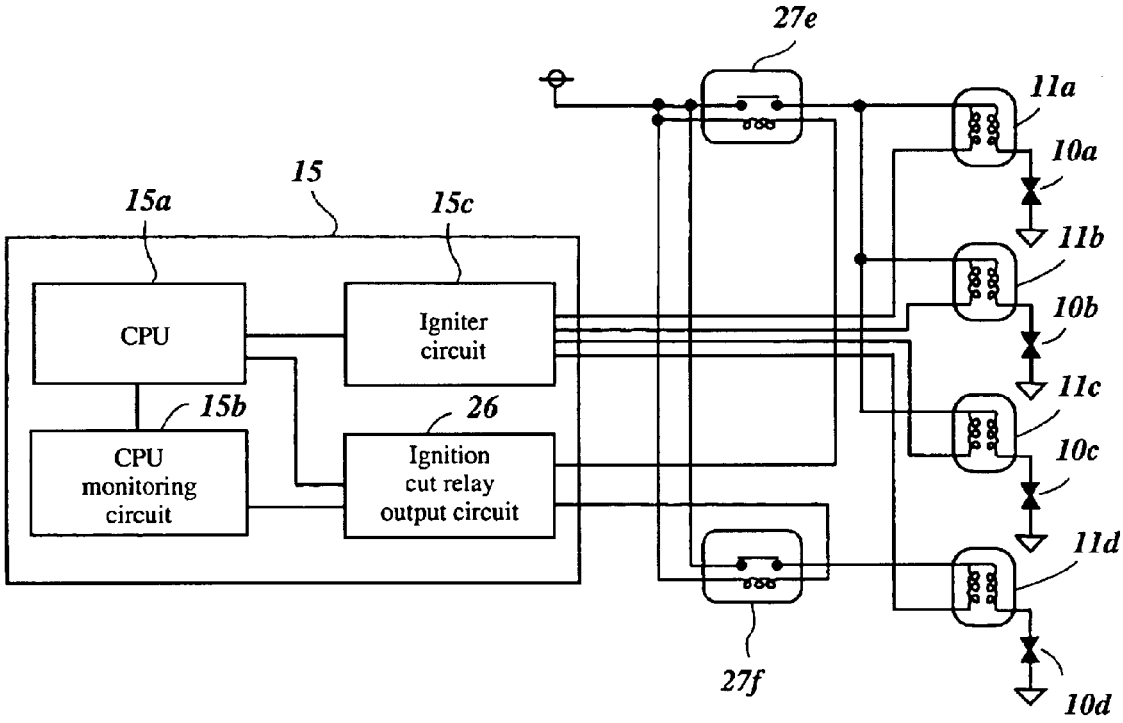
FIG. 16 is a block diagram showing still another example of the ignition control section of FIG. 2.

For a smooth decrease in engine torque, it is preferable to stop the ignition on a cylinder-by-cylinder basis in accordance with the foregoing embodiments. However, for many four-cylinder engines, the operator does not develop an uneasy feeling even when the ignition is stopped initially for three cylinders, for example, and then the remaining cylinder is stopped after a selected time duration. FIG. 16 illustrates an arrangement of the ignition control section 45 in which ignition control of four cylinders is performed such that ignition is stopped initially for three cylinders and then the ignition is stopped for the remaining cylinder. In the arrangement of FIG. 16, a first ignition cut relay 27*e* is disposed between a power source and the ignition coil 11*a* of the first cylinder, the ignition coil 11*b* of the second cylinder and the ignition coil 11*c* of the third cylinder. Thus, opening the contacts of the first ignition cut relay 27*e* disconnects the power to the inputs of the first, second and third ignition coils 11*a*, 11*b*, 11*c*. A second ignition cut relay 27*f* is disposed between the power source and the ignition coil 11*d* of the fourth cylinder. Therefore, when a failure or error is detected, the first ignition cut relay 27*e* is first opened to stop the ignition pulses to the first, second and third ignition coils 11*a*, 11*b*, 11*c*. Then, after a selected time, the second ignition cut relay 27*f* is opened to stop the ignition pulses to the fourth ignition coil 11*d*.

Although in the foregoing embodiment, description is made on an in-intake pipe injection type engine, the engine control device of this invention can also be applied to a direct injection type engine similarly.

In addition, although in the foregoing embodiment, description is made on a so-called multi-cylinder type engine with four cylinders, the engine control device of this invention can also be applied to a single cylinder engine similarly, except for the embodiments of FIGS. 14, 15 and 16 where ignition is stopped on a cylinder-by-cylinder basis.

As described above, an engine control device according to the preferred embodiments of the present invention causes the engine torque to be gradually decreased when a failure is detected so that any uneasy feeling that an operator might otherwise experience if the torque is abruptly changed is reduced.

In one particular embodiment, the closing speed of a throttle valve is controlled to gradually decrease engine torque. The throttle valve is initially closed quickly and is then closed slowly to cause the engine torque to be decreased smoothly.

In another particular embodiment, the engine control device is arranged such that engine torque is slowly decreased by at least one of delayed ignition timing, a thinning-out of ignition timing, and a cylinder-by-cylinder stopping of ignition. Therefore, if the ignition timing is delayed little by little or if the ignition is thinned out little by little or if the ignition is stopped on a cylinder-by-cylinder basis, the engine torque can be decreased smoothly to reduce any uneasy feeling that an operator might otherwise experience.

In one embodiment, the engine control device includes a relay circuit for stopping ignition the ignition on a cylinder-by-cylinder basis when a failure is detected, thereby enabling engine torque to be decreased reliably and gradually even when a requisite CPU for electronic control fails.

What is claimed is:

1. A two-wheeled vehicle having an engine comprising:

an engine control device including sensors, an engine body including a cylinder body having at least one variable volume combustion chamber, an ignition system having at least one ignition coil and at least one igniter, said igniter configured to ignite an air/fuel mixture within said combustion chamber, said igniter being operated according to a predetermined ignition timing, a throttle actuator position sensor delivering a signal representing a drivers torque request to an electronic control unit, said electronic control unit activating a an actuator, said actuator activating a throttle valve, a sensor failure detection system that monitors a plurality of sensors that are responsive to operational parameters of said two-wheeled vehicle, said failure detection system detecting an unacceptable output of at least one of said sensors, and a controller responsive after a predetermined period of time following said unacceptable output detected by said failure detection system to selectively vary engine parameters to slow said engine at a predetermined gradual rate.

2. A two-wheeled vehicle as set forth in claim 1, wherein at least one engine parameter varied to slow said engine at a predetermined gradual rate is the position of a throttle valve.

3. A two-wheeled vehicle as set forth in claim 1, wherein at least one engine parameter varied to slow said engine at a predetermined gradual rate is the ignition timing.

4. A two-wheeled vehicle as set forth in claim 1, wherein said engine is slowed at a predetermined gradual rate by suppressing ignition pulses to at least one of said variable volume combustion chambers.

5. A two-wheeled vehicle as set forth in claim 1, wherein a relay circuit stops ignition pulses to at least one of said variable volume combustion chambers.

6. A two-wheeled vehicle as set forth in claim 1, wherein said sensors include a side stand switch.

7. A two-wheeled vehicle as set forth in claim 1, wherein said sensors include an inverted detection switch.

8. A two-wheeled vehicle as set forth in claim 1, wherein said sensors include a throttle actuator sensor.

9. A two-wheeled vehicle as set forth in claim 1, wherein said sensors include a throttle position sensor.

10. A two-wheeled vehicle comprising an engine, said engine comprising a throttle valve and an ignition plug, an actuator drivingly engaged with said throttle valve, a engine control device communicating with said actuator and said ignition plug, an accelerator demand sensor communicating with said engine control device, a throttle sensor communicating with said engine control device, a side stand switch communicating with said engine control device and a turnover switch communicating with said engine control device, said engine control device adapted to determine when a failure occurs of a sensor selected from the group consisting of said accelerator demand sensor, said throttle sensor, said side stand switch and said turnover switch, said engine control device further adapted to reduce engine torque when said failure of said sensor exceeds a predetermined period of time by gradually varying an engine control parameter, said engine control parameter being selected from the group consisting of ignition timing and throttle opening.

11. The vehicle of claim 10, wherein gradually varying ignition timing comprises an action selected from the group consisting of delaying ignition timing, thinning ignition frequency and cylinder-by-cylinder ignition stoppage.

12. The vehicle of claim 10, wherein gradually varying throttle opening comprises closing said throttle valve at a constant linear rate.

13. The vehicle of claim 12, wherein gradually varying throttle opening comprises closing said throttle valve at two different constant linear rates.

14. The vehicle of claim 10, wherein gradually varying throttle opening comprises closing said throttle valve at a rate that decreases with time.

15. The vehicle of claim 14, wherein said rate comprises a first constant speed and a second constant speed.

16. The vehicle of claim 14, wherein said rate varies throughout the closing.

17. The vehicle of claim 10, wherein said engine control device further alters the second parameter selected from the group consisting of ignition timing and throttle opening.

18. The vehicle of claim 10, wherein said engine control parameter is ignition timing and said engine control device comprises a relay circuit for inhibiting ignition on a cylinder-by-cylinder basis.

19. The vehicle of claim 18, wherein said relay circuit is adapted to function if a control unit comprising the engine control device fails.

20. A two-wheeled vehicle as set forth in Claim 1, wherein said actuator comprises a motor.

21. A two-wheeled vehicle as set forth in Claim 20, wherein said motor comprises a stepper motor.

22. A two-wheeled vehicle as set forth in Claim 10, wherein said actuator comprises a motor.

23. A two-wheeled vehicleas set forth in Claim 22, wherein said motor comprises a stepper motor.

* * * * *